US005407053A

United States Patent [19]

Suzuki et al.

[11] Patent Number: 5,407,053

[45] Date of Patent: Apr. 18, 1995

[54] HOPPER APPARATUS FOR ROD MEMBERS

[75] Inventors: Minoru Suzuki; Shuichiro Oku, both of Tokyo, Japan

[73] Assignee: Japan Tobacco Inc., Tokyo, Japan

[21] Appl. No.: 166,000

[22] Filed: Dec. 14, 1993

[30] Foreign Application Priority Data

Dec. 14, 1992 [JP] Japan ..... 4-332868

[51] Int. Cl.[6] ..... B65G 37/00

[52] U.S. Cl. ..... 198/347.1; 198/493; 131/282

[58] Field of Search ..... 198/493, 347.1, 572, 198/524, 573, 568; 131/282, 283

[56] References Cited

U.S. PATENT DOCUMENTS

| | | | |
|---|---|---|---|
| 3,608,972 | 9/1968 | Rudszinat | 198/624 X |
| 3,620,349 | 11/1971 | McCombie | 198/572 X |
| 3,799,324 | 3/1974 | Hall | 198/524 X |
| 4,352,604 | 10/1982 | Carascon et al. | 131/282 X |
| 4,368,742 | 1/1983 | Wahle et al. | 198/568 X |
| 4,580,939 | 4/1986 | Dyett et al. | 198/347.1 |
| 4,790,333 | 12/1988 | Focke et al. | 131/282 X |
| 4,863,087 | 9/1989 | Kohler | 226/197 |
| 5,156,169 | 10/1992 | Holmes et al. | 131/60 |

FOREIGN PATENT DOCUMENTS

| | | |
|---|---|---|
| 0118984 | 9/1984 | European Pat. Off. . |
| 0261271 | 3/1988 | European Pat. Off. . |
| 0342491 | 11/1989 | European Pat. Off. . |
| 0401886 | 12/1990 | European Pat. Off. . |
| 2311507 | 12/1976 | France . |
| 3334879 | 12/1984 | Germany . |
| 8423013 | 4/1986 | Germany . |
| 2068325 | 8/1981 | United Kingdom . |
| 2202127 | 9/1988 | United Kingdom . |
| 92/15513 | 9/1992 | WIPO . |

*Primary Examiner*—Cheryl L. Gastineau

[57] ABSTRACT

A hopper apparatus for rod members comprises a hopper for storing filter rods as the rod members, a pair of rod feeders for feeding the filter rods independently into the hopper, and a rotatable hopper drum for taking out the filter rods one by one from the hopper through a discharge port thereof.

6 Claims, 2 Drawing Sheets

HOPPER APPARATUS FOR ROD MEMBERS

BACKGROUND OF THE INVENTION

1. Field of the Invention

The present invention relates to a hopper apparatus incorporated, for example, in a filter cigarette manufacturing machine and adapted temporarily to store filter rods as rod members.

2. Description of the Related Art

In a filter cigarette manufacturing machine, which is called a filter attachment, filter cigarettes are manufactured by connecting filters to cigarettes. More specifically, in the filter attachment, a filter plug is first interposed between each two cigarettes which are arranged Coaxially. The two cigarettes and the filter plug are connected to one another by being wrapped in a paper piece, whereupon a double-size filter cigarette is prepared. Thereafter, the double-size cigarette is cut in the center of the filter plug to be divided into two equal parts or regular filter cigarettes.

The filter plug is obtained by cutting each of filter rods, taken out one after another from a hopper, into pieces with a predetermined length.

In recent years, there is a tendency for the operation speed of modern filter attachments to be increased for higher-efficiency filter cigarette production. Accordingly, the number of filter rods taken out from the hopper per unit time, that is, filter rod consumption, also increases.

It is to be desired, therefore, that a large number of filter rods should be previously stored in the hopper. To attain this, however, the hopper requires a large capacity, inevitably entailing an increase in size of the filter attachment itself.

Despite the large capacity, the hopper can store only a limited number of filter rods. When the residual filter rods in the hopper run short, therefore, the hopper must be replenished with new filter rods.

If the hopper replenishment speed is too low, storing a predetermined quantity of filter rods in the hopper takes a long time. If the speed of taking out the filter rods from the hopper or filter rod consumption speed is too high, moreover, the operation of the filter attachment must be suspended until the resupply of the filter rods is completed. Thus, the operating efficiency of the filter attachment is inevitably lowered.

SUMMARY OF THE INVENTION

The object of the present invention is to provide a hopper apparatus for rod members, capable of coping with a higher speed of rod member consumption without entailing an increase in the size of a hopper itself.

The above object is achieved by a hopper apparatus for rod members according to the present invention, which comprises: a hopper for storing the rod members, the hopper having an open end opening sideways, a closed end opposite the open end, and a bottom wall extending from the open end to the closed end; a plurality of rod feeders arranged above and below on the open end side of the hopper, each rod feeder having one end facing to the interior of the hopper, the other end outside the hopper, and a feed passage connecting the one end and the other end, whereby the rod members received at the other end of the rod feeder are transported through the feed passage and delivered into the hopper through the one end, each said rod feeder including both a pair of vertically spaced belt conveyors for defining the feed passage and a chute declining from the one end thereof toward the bottom wall of said hopper. Supply means are provided for supplying the rod members to the other end of each rod feeder in a manner such that the axis of each rod member is oriented so as to extend at right angles to the feed passage. Discharge means are provided for discharging the rod members one by one from the hopper.

According to the hopper apparatus described above, the rod members are fed from the individual rod feeders into the hopper. Thus, a predetermined quantity of rod members can be continually stored in the hopper even though the rate of delivery of the rod members from the hopper, that is, speed of rod member consumption by the discharge means, is higher than the speed of rod member resupply by means of each rod feeder. As a result, the hopper itself need not be increased in size, and the time required for the rod member resupply can be shortened.

Preferably, each rod feeder includes a pair of vertically spaced belt conveyors for defining the feed passage, and a chute for the rod members extends from the rod feeder toward the bottom wall of the hopper.

While the chute of the lowest rod feeder is fixed, in this case, the chute of each of the rod feeders which are situated above the lowest rod feeder is supported for rocking motion as a swinging chute.

A swinging chute vertically rocks in accordance with the storage of the rod members fed from the lower chutes into the hopper, thereby varying the position where the rod members are fed from the rod feeder with the swinging chute into the hopper. Thus, the rod members fed from the rod feeders are accumulated uniformly on the bottom wall of the hopper.

Preferably, furthermore, the bottom wall of the hopper is formed of a belt conveyor. In this case, the rod members accumulated on the belt conveyor are compulsorily transported toward a discharge port of the hopper.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENT

Figure 1:
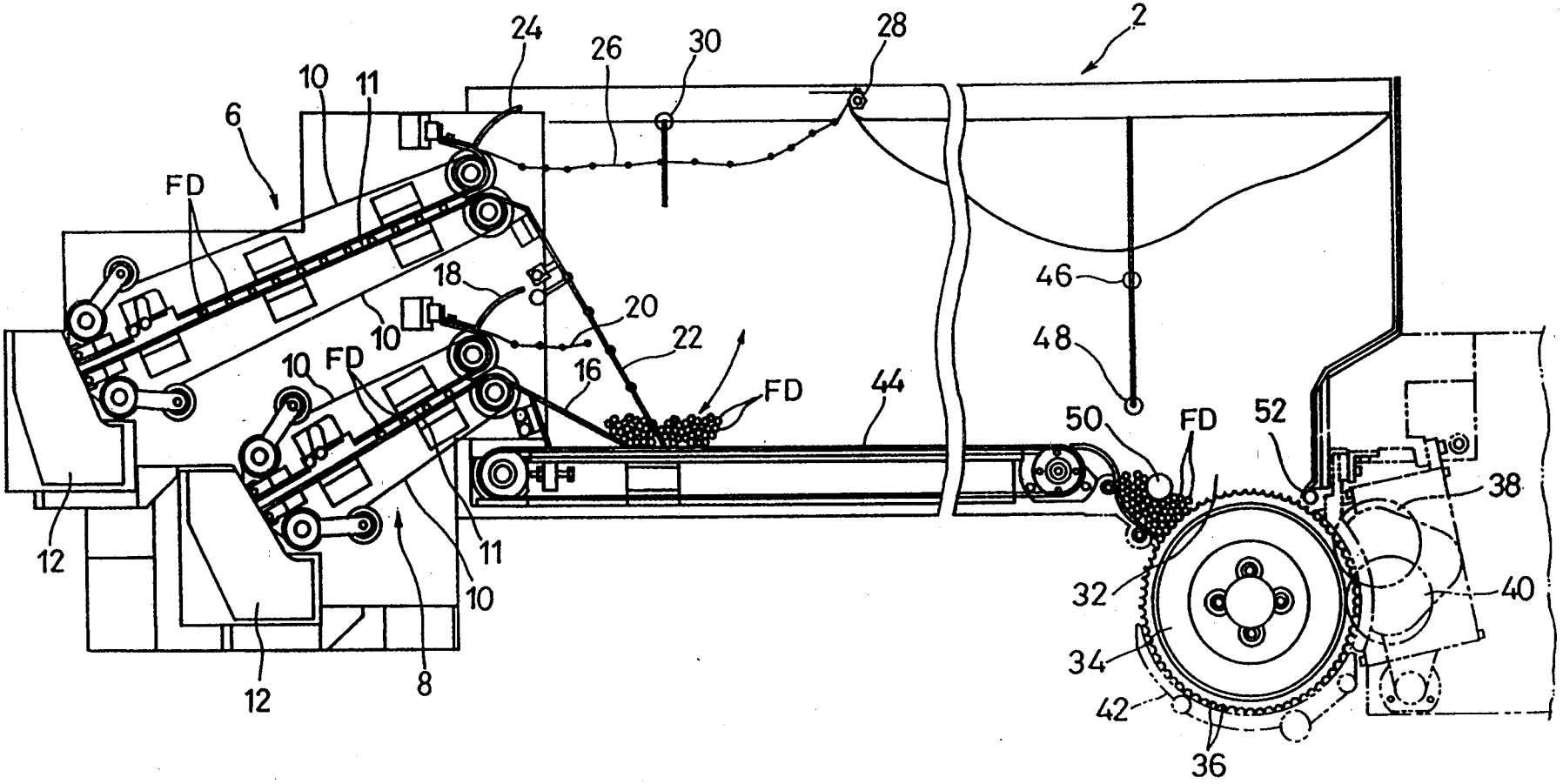
FIG. 1 is a schematic view showing a hopper apparatus according to one embodiment of the present invention.

A hopper apparatus shown in FIG. 1, which is incorporated in a filter attachment, is provided with a hopper 2. The hopper 2 is in the form of a horizontally elongated box, having its depth set in accordance with the length of each of filter rods FD. As mentioned before, the filter rods FD are used for the manufacture of filter cigarettes.

Referring to FIG. 1, the left-hand end wall of the hopper 2 is open, and a pair of rod feeders 6 and 8 are provided on the left-hand end wall side. As seen from FIG. 1, the feeders 6 and 8 are arranged above and below, and are inclined upward toward the hopper 2.

More specifically, each rod feeder has an upper end facing to the interior of the hopper 2 and a lower end situated outside the hopper. Thus, each rod feeder extends downward from the left-hand end of the hopper 2.

Since the rod feeders 6 and 8 are constructed substantially in the same manner, only one of these feeders will be described below.

The rod feeder includes a pair of belt conveyors 10, upper and lower, and a feed passage 11 for the filter rods FD is defined between the conveyors 10. The vertical width of the feed passage 11 is a little shorter than the diameter of each filter rod FD. One of the belt conveyors 10, therefore, can move upward or downward to adjust the width of the feed passage 11.

Each belt conveyor 10 includes an endless belt, which is passed around and between a driving roller and a driven roller. The respective endless belts of the paired belt conveyors 10 are driven in opposite directions. More specifically, one run of the belt of the one belt conveyor and the other run of the belt of the other belt conveyor define the feed passage 11. These two runs travel in synchronism with each other toward the hopper 2.

Figure 2:
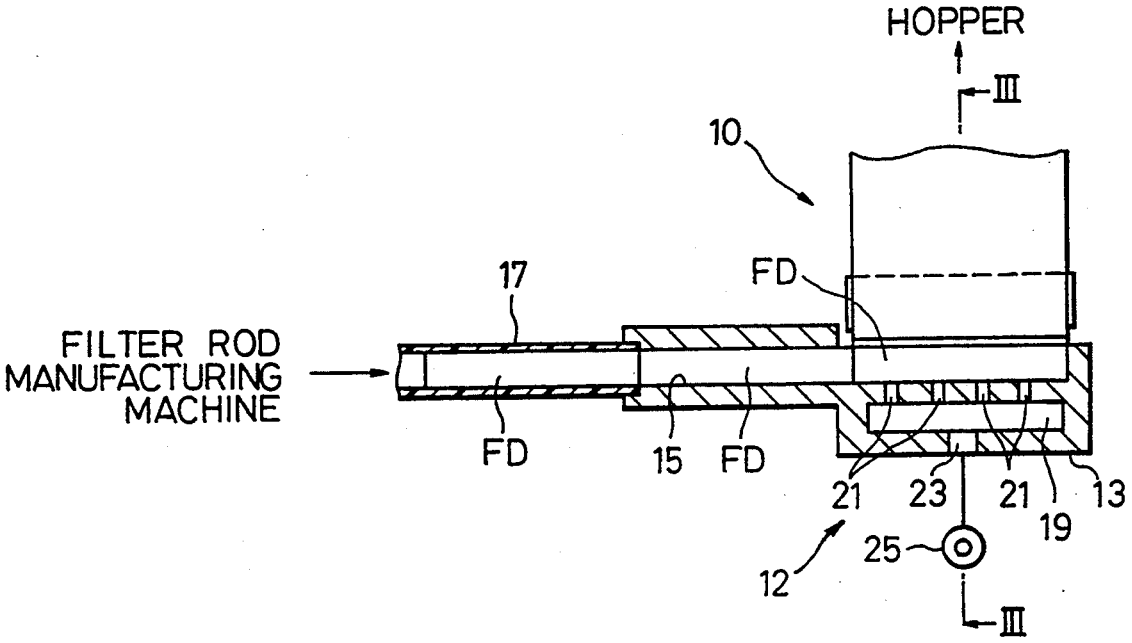
FIG. 2 is a sectional view showing a rod receiving section of the hopper apparatus.
Figure 3:
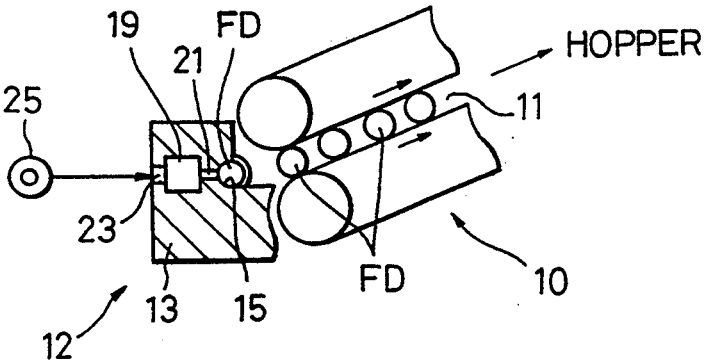
FIG. 3 is a sectional view taken along line III—III of FIG. 2.

The lower end of the rod feeder is connected to a rod delivery section 12. As shown in FIGS. 2 and 3, the delivery section 12 comprises a receiving body 13, which is formed with an internal passage 15. The internal passage 15 extends at right angles to the axial direction of the belt conveyors 10. The passage 15 has one end opening in the outer surface of the receiving body 13, and the other end thereof is closed.

A flexible tube 17 is connected to the one end of the internal passage 15, and is also connected to a filter rod manufacturing machine (not shown). This manufacturing machine feeds the manufactured filter rods FD successively into the tube 17, and transports the filter rods in the tube 17, along with an air current, toward the rod delivery section 12.

Further, the receiving body 13 has an opening at that portion which faces the respective lower ends of the paired belt conveyors 10. The terminal end region of the internal passage 15 is exposed to the feed passage 11 between the belt conveyors 10 through this opening. Defined in the receiving body 13, moreover, is an air chamber 19 which extends along the terminal end region of the internal passage 15. The air chamber 19 is connected to the terminal end region of the passage 15 through a plurality of jets 21, on the one side. On the other side, the chamber 19 connected to a compression air source 25 through a port 23.

The filter rods FD from the filter rod manufacturing machine, transported together with air through the tube 17, are pushed successively into the internal passage 15 of the receiving body 13, and advance in the passage 15 so as to run against the closed end thereof.

The leading filter rod FD in the terminal end region of the internal passage 15 is subjected to the blow pressure of air ejected from the air chamber 19 through the jets 21, and are pushed out into the feed passage 11 between the paired belt conveyors 10. As the paired belt conveyors 10 travel, therefore, the leading filter rod FD is transported in the feed passage 11 in the direction perpendicular to the axis of the filter rod FD, and is fed into the hopper 2 through the upper end of the rod feeder. Thus, the filter rods FD are stored in the hopper 2 in a manner such that their respective axes are uniformly oriented, extending at right angles to the drawing plane of FIG. 1.

Referring again to FIG. 1, a fixed chute 16 extends from the upper end of the rod feeder 8, that is, the upper end of the lower one of the paired belt conveyors 10 of the feeder 8. The chute 16 declines toward the bottom wall of the hopper 2. Also, an arcuate guide 18 extends from the upper end of the upper belt conveyor 10 of the rod feeder 8. A roller chain 20 is connected to the lower end of the guide 18. The chain 20 extends under the guide 18, and its extreme end is a free end. In this arrangement, the filter rods FD are fed from the upper end of the rod feeder 8 into the space between the fixed chute 16 and the roller chain 20, and are guided along the chute 16 to be accumulated on the bottom wall of the hopper 2.

Likewise, a swinging chute 22 extends from the upper end of the lower belt conveyor 10 of the rod feeder 6. The chute 22 also declines toward the bottom wall of the hopper 2. The swinging chute 22 is swingable in the direction of the arrow of FIG. 1 around its upper end. The lower end of the chute 22 is situated on the right (FIG. 1) of the lower end of the fixed chute 16. Thus, the swinging chute 22 rocks upward as the storage of the filter rods FD fed from the rod feeder 8 increases.

Meanwhile, an arcuate guide 24 extends from the upper end of the upper belt conveyor 10 of the rod feeder 6, and a roller chain 26 is connected to the lower end of the guide 24. The chain 26 extends under the guide 24 so as to reach the right-hand end wall of the hopper 2, and its extreme end is connected to the top portion of the right-hand end wall. The middle portion of the roller chain 26 is moored to an anchor 28 which is attached to the top wall of the hopper 2.

Thus, the filter rods FD are fed from the rod feeder 8 into the space between the roller chain 26 and the swinging chute 22, and are guided along the chute 22 to be accumulated on the bottom wall of the hopper 2.

As the filter rods FD are gradually stored in the hopper 2, they push up the roller chain 26, while the chain 26 softly presses down the stored filter rods FD. When the filter rods FD are transported by means of a hopper conveyor (mentioned later), therefore, they can be prevented from being disordered.

When the storage of the filter rods FD in the hopper 2 reaches its maximum permissible limit, the uppermost filter rod switches on a fullness sensor 30. In response to an on-signal from the sensor 30, the paired rod feeders 6 and 8 cease to feed the filter rods FD into the hopper 2. As seen from FIG. 1, the fullness sensor 30 is located in the top portion of the hopper 2 on the rod feeder side.

The bottom wall of the hopper 2 has a discharge port 32 protruding downward from the right-hand end portion of thereof.

The discharge port 32 is closed by a hopper drum 34. As the drum 34 rotates, the filter rods FD in the hopper 2 are taken out one after another. More specifically, the hopper drum 34 is positioned so that part of its outer peripheral surface faces on the discharge port 32, and a number of receiving grooves 36 are formed on the outer peripheral surface so as to be arranged at intervals in the circumferential direction of the drum. When these grooves 36 are situated within the discharge port 32, they receive the filter rods FD in the port 32 one by one, and hold the received rods under a suction pressure.

Thus, as the hopper drum 34 is rotated in the clockwise direction of FIG. 1 at a predetermined speed, the filter rods FD received from the discharge port 32 by the receiving grooves 36 are taken out one after another from the hopper 2.

The hopper drum 34 is provided with a pair of rotatable circular knives 38 and, 40, which are shown only schematically in FIG. 1. As the drum 34 rotates, the knives 38 and 40 cut each delivered filter rod FD into three equal parts. In this manner, three coaxial filter plugs are formed from each filter rod.

The filter plugs thus obtained are transported to a cigarette transportation path by means of a drum train (not shown) which extends from the hopper drum 34. The drum train comprises a plurality of grooved drums which resemble the hopper drum 34. The filter rods transfer from one grooved drum to another as they are transported toward the cigarette transportation path. In this process of transportation, the three filter plugs are lined up in the transportation direction.

On the cigarette transportation path, in this arrangement, each filter plug is fed between each pair of cigarettes, as mentioned before. The two cigarettes and the filter plug are coupled together by being wrapped in a paper piece, whereby a double-size filter cigarette is obtained. Thereafter, the double-size filter cigarette is cut into two equal parts or regular filter cigarettes.

As shown in FIG. 1, moreover, the outer peripheral surface of the hopper drum 34 is covered by an arcuate guide 42, which extends from the circular knife 40 to the starting end of the drum train. Even when the operation of the hopper apparatus is suspended so that the suction pressure on the filter rods FD is removed, the filter rods can be prevented from slipping out of the hopper drum 34.

On the bottom wall of the hopper 2, a hopper conveyor 44 extends close to the discharge port 32 from the rod feeder 8. The conveyor 44 substantially constitutes the bottom wall of the hopper 2. When the conveyor 44 is driven, the filter rods FD accumulated on the top side are transported toward the discharge port 32.

The drive of the hopper conveyor 44 is controlled by means of a replenishment sensor 46 and a lower limit sensor 48 which are located over the discharged port 32. Thus, when the top layer of the stacked filter rods FD is lowered to a level below the location of the replenishment sensor 46, the sensor 46 outputs an on-signal. In response to this on-signal, the drive of the hopper conveyor 44 is started. As the conveyor 44 is driven, thereafter, the filter rods FD are accumulated in a predetermined quantity over the discharge port 32. When the top layer of the filter rods FD reaches a level above the location of the replenishment sensor. 46, the drive of the hopper conveyor 44 is stopped in response to an off-signal from the sensor 46. In this manner, the predetermined number of filter rods FD can be continually secured over the discharge port 32.

If the rod chain 26 falls below the lower limit sensor 48 from any cause, an on-signal is delivered from the sensor 48. In this case, it is concluded that there is something wrong with the feed of the filter rods FD into the hopper 2 or the drive of the hopper conveyor 44. Thereupon, the rotation of the hopper drum 34 is stopped at once, and at the same time, the operation of the whole filter attachment is stopped.

An agitator roller 50 is disposed in the discharge port 32 with a given space between the roller 50 and the left-hand inner wall (FIG. 1) of the port 32. The roller 50, in contrast with the hopper drum 34, is rotated in the counterclockwise direction of FIG. 1. The agitator roller 50 has arcuate grooves (not shown) arranged at intervals on its outer peripheral surface. As the roller 50 rotates, the surrounding filter rods FD are agitated by the grooves. The horizontal distance between the roller 50 and the left-hand inner wall of the discharge port 32 is equivalent to the sum of the respective diameters of several filter rods FD. The vertical distance between the agitator roller 50 and the hopper drum 34 is shorter than the horizontal distance by a margin corresponding to one or two filter rods FD.

The gap between the hopper drum 34 and the right-hand inner wall of the discharge port 32 is closed by a small refuser roller 52 which has a knurl on its outer peripheral surface. The roller 52 rotates in the clockwise direction of FIG. 1, thereby preventing the filter rods FD from being caught in the gap.

According to the hopper apparatus described above, the upper and lower rod feeders 6 and 8 can be used for the feed of the filter rods FD into the hopper 2, so that the filter rods supply to the hopper 2 per unit time can be increased.

Accordingly, the rotation of the hopper drum 34 is speeded up. Even though the rate of delivery of the filter rods FD from the hopper 2, that is, speed of filter rod consumption, is higher than the speed of filter rod resupply by means of each rod feeder, therefore, the predetermined quantity of filter rods can be continually stored in the hopper 2 by simultaneously operating the upper and lower rod feeders 6 and 8. Thus, the filter rods can be continuously supplied to the filter attachment without entailing an increase in size of the hopper 2, so that the operating efficiency of the filter attachment cannot be lowered.

When the filter rods FD introduced from the rod feeder 8 are gradually accumulated on the hopper conveyor 44, according to one embodiment, the accumulated filter rods cause the swinging chute 22 to rock upward. The rocking motion of the chute 22 varies the position where the filter rods FD are fed from the rod feeder 6 into the hopper 2 through the chute 22. This indicates that the positions where the filter rods FD are fed from the paired rod feeders 6 and 8 into the hopper 2 are always different from each other. Accordingly, the filter rods FD fed from the rod feeder 6 into the hopper 2 and accumulated on the bottom wall of the hopper 2 never hinder the feed of the filter rods from the rod feeder 8. Thus, the filter rods FD fed from the rod feeders 6 and 8 accumulate uniformly on the bottom wall of the hopper 2 or the hopper conveyor 44.

It is to be understood that the present invention is not limited to the embodiment described above, and that various changes and modifications may be effected therein by one skilled in the art without departing from the scope or spirit of the invention. According to the above embodiment, for example, the hopper 2 is provided with a pair of rod feeders. Alternatively, however, the hopper may be furnished with three or more rod feeders, and there are no restrictions on the number of rod feeders used. Although the rod feeders are inclined according to the above-described embodiment, moreover, it is to be understood that they may be arranged horizontally with the same effect. Furthermore, the hopper apparatus may be applied to various other rod members than the filter rods for cigarettes.

What is claimed is:

1. A hopper apparatus for rod members, comprising:

a hopper for storing the rod members, said hopper having an open end opening sideways, a closed end opposite the open end, and a bottom wall extending from the open end to the closed end;

a plurality of rod feeders arranged above and below on the open end side of said hopper, each said rod feeder having one end facing to an interior of said hopper, the other end outside said hopper, and a feed passage connecting the one end and the other end, whereby the rod members received at the other end of said rod feeder are transported through the feed passage and delivered into said hopper through the one end, each said rod feeder including both a pair of vertically spaced belt conveyors for defining the feed passage and a chute declining from the one end thereof toward the bottom wall of said hopper;

supply means for supplying the rod members to the other end of each said rod feeder in a manner such that the axis of each rod member is oriented so as to extend at right angles to the feed passage; and discharge means for discharging the rod members one by one from said hopper.

2. A hopper apparatus according to claim 1, wherein the chute of the lowest rod feeder is fixed, and the chute of each of the other rod feeders has an upper end situated on the one end side of the rod feeder and is rockable around the upper end as a fulcrum.

3. A hopper apparatus according to claim 1, wherein said discharge means includes a discharge port provided on the bottom wall of said hopper so as to be situated on the closed end side thereof and a delivery drum arranged for rotation so as to close the discharge port, the delivery drum having delivery grooves arranged spaced in the circumferential direction on the outer peripheral surface thereof and receiving the rod members one by one from said hopper.

4. A hopper apparatus according to claim 3, wherein the bottom wall of said hopper includes a belt conveyor extending from the open end of said hopper toward the discharge port.

5. A hopper apparatus according to claim 1, wherein said supply means includes a delivery section for each corresponding rod feeder, the delivery section including a receiving passage extending at right angles to the feed passage of said rod feeder, the receiving passage having a terminal end on the other end side of said rod feeder such that the rod members introduced into the receiving passage advance therein and cease to advance when stopped by the terminal end, and push means for pushing out each rod member having reached the terminal end of the receiving passage toward the other end of said rod feeder.

6. A hopper apparatus according to claim 5, wherein the push means includes blower means for applying an air pressure to the rod member.

* * * * *